US008740337B2

(12) United States Patent
Mills, III et al.

(10) Patent No.: US 8,740,337 B2
(45) Date of Patent: Jun. 3, 2014

(54) WRINKLE ELIMINATION FOR SOLID INKJET WEB PRINTER

(75) Inventors: Borden Hicks Mills, III, Webster, NY (US); John Leonard Hryhorenko, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 24 days.

(21) Appl. No.: 13/562,687

(22) Filed: Jul. 31, 2012

(65) Prior Publication Data

US 2014/0035984 A1 Feb. 6, 2014

(51) Int. Cl.
*B41J 29/38* (2006.01)
*B41J 13/02* (2006.01)
*B41J 15/16* (2006.01)

(52) U.S. Cl.
CPC ..... *B41J 13/025* (2013.01); *B41J 15/16* (2013.01); *B65H 2515/34* (2013.01)
USPC ..... 347/16

(58) Field of Classification Search
CPC .. B41J 2/17593; B41J 11/0015; B41J 13/025; B41J 15/16; B65H 2515/34
USPC ..... 347/16, 88, 99, 101, 103, 104
See application file for complete search history.

(56) References Cited

U.S. PATENT DOCUMENTS

| | | | | |
|---|---|---|---|---|
| 7,828,423 | B2 * | 11/2010 | Larson et al. | 347/88 |
| 8,073,373 | B2 * | 12/2011 | Kitami | 399/327 |
| 2011/0025791 | A1 | 2/2011 | Law et al. | |
| 2011/0102525 | A1 | 5/2011 | Larson et al. | |

* cited by examiner

*Primary Examiner* — An Do
(74) *Attorney, Agent, or Firm* — Raymond L. Owens

(57) ABSTRACT

A solid inkjet web printer for reducing wrinkles on a web including a solid ink jet engine for jetting a patterned layer of solid jettable ink and a system having a processor, and a spreader, the spreader having a pressure roller and a spreader roller forming a nip and means for adjusting the force applied at the nip. The processor controls the adjustment of the force applied by the pressure and spreader rollers to the printed portion on the web causing the spreader to reduce the force when the non-image portion is in the nip. A sensor for providing a signal to the processor indicates the location of the image and non-image portions of the web.

4 Claims, 1 Drawing Sheet

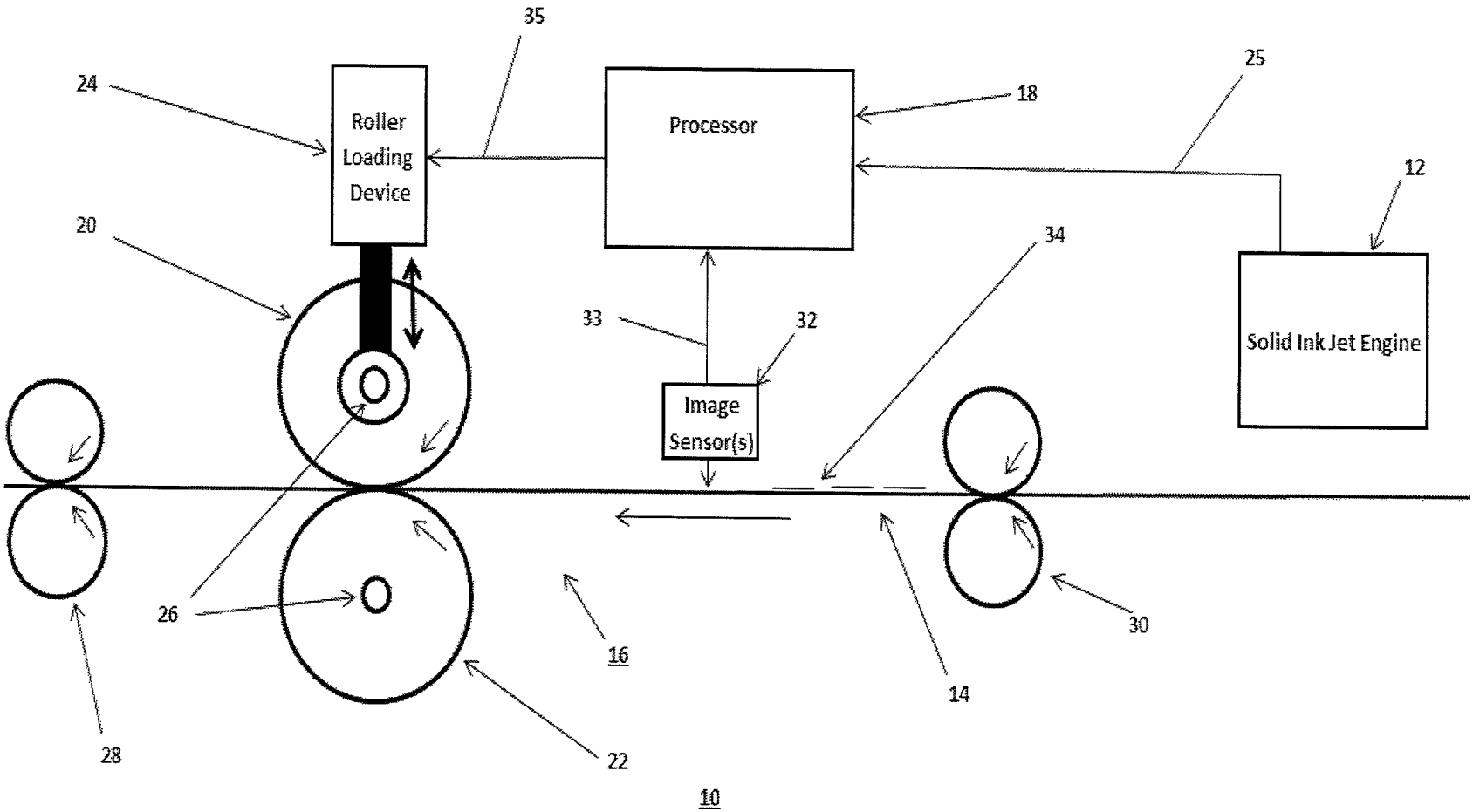
Solid Ink Jet Engine
12
25
18
Processor
35
Roller Loading Device
24
20
26
28
22
16
10
14
30
34
32
Image Sensor(s)
33

WRINKLE ELIMINATION FOR SOLID INKJET WEB PRINTER

FIELD OF THE INVENTION

The present invention relates to reducing wrinkles in the continuous web solid ink jet printer

BACKGROUND OF THE INVENTION

Solid ink jet printers can use opposing nipped rollers wherein at least one is conformable to form a nip in which pressure and optionally heat are used to partially or fully melt the ink to reduce the height of the ink and spread the ink. A spreader may be necessary to enhance the image quality of the print. Spreader stations described in the current art are basically comprised of pairs of opposing rollers, where at least one is conformable, form a nip, similar to those used in fusers in the field of electrophotography. Most high speed commercial inkjet printers use continuous paper rolls, instead of paper sheets. One performance concern of the spreader station used in this application is wrinkles in the paper prints.

Print wrinkles and image artifacts are caused by stresses built up in the web as it passes through the fuser or spreader nip. The stresses are caused by variations in the image thickness, variations in web thickness caused by variations in relative humidity, differential moisture absorption by the web and variations in the outside diameter or conformable layer thickness of the spreader or pressure rollers caused by differential axial temperature or manufacturing tolerances. In a sheet fed application, these stresses are eliminated as each sheet exits the fuser or spreader. In a web application, the stresses are not eliminated for a very long time, given many paper rolls are 20,000 feet long, or more. Thus, paper wrinkles are a large concern in a web-fed solid inkjet printer.

SUMMARY OF THE INVENTION

In accordance with the present invention there is provided a solid inkjet web printer for reducing wrinkles on a web comprising;

a solid ink jet engine for jetting a patterned layer of solid jettable ink against a printed portion of the web; and a system having a processor, and a spreader, the spreader having a pressure roller and a spreader roller wherein at least one is comformable forming a nip and means for adjusting the force applied at the nip; the processor causing the adjustment of the force applied by the pressure and spreader rollers to the printed portion on the web when the web is in the nip to spread the printed portion on the web; and causing the spreader to reduce the nip force when the non-image portion is in the nip; and a sensor for providing a signal to the processor indicating the location of the image and non-image portions of the web and the processor responding to the signal for causing the force adjusting means to reduce the force at the nip when the non-image portion is in the nip.

An advantage of the present invention is that by reducing force at the nip when the non-image bearing portion of the web is in the nip, stresses are reduced and wrinkles are also reduced. A feature of the present invention is that the processor can use image content information to determine the amount of force to be applied by the roller loading device, to aid wrinkle reduction.

BRIEF DESCRIPTION OF THE DRAWING

FIG. 1 is a schematic diagram of a solid ink jet printer that can practice the present invention.

DETAILED DESCRIPTION OF THE INVENTION

This invention reduces wrinkles in a web-fed solid ink printer by reducing the force between a pressure roller and a spreader roller or by separating them between the images.

Turning now to FIG. 1, there is shown a solid inkjet web printer 10 that reduces wrinkles on a web 14. A solid ink jet web printer 10 is a type of drop on demand printing system. It uses ink that begins as a solid at ambient conditions and is heated to a liquid state for the ink jet process. It is also known as a phase change inkjet printer. While in a heated liquid state, ink is jetted via impulses of a piezo-electric crystal to a transfer cylinder or directly to the substrate, in this case a web 14. The ink is then cooled back to a solid on the cool substrate. The solid ink jet printing engine is well known in the art. Examples of such engines and materials are shown in US Patent Publications US 2011/0025791 and US 2011/0102525.

A solid ink jet engine 12 is used for jetting a patterned layer of solid jettable ink against a printed portion of the web 14. The solid ink jet engine 12 receives image data representing an image to be printed, which causes the engine to melt the solid ink and deposit the correct amount of liquefied ink in the correct image pattern on the web 14. Solid ink jet printing engines are well known in the art and include a heater that can cause the solid ink to melt and a mechanism for jetting the solid ink onto the continuous web 14. A piezoelectric arrangement can be used in the jetting process.

The solid ink jet web printer 10 includes a spreader 16, at least one roller loading device 24 and a processor 18. The processor receives a signal 25 from the solid ink jet engine 12 representing image content.

As is conventional in the spreader 16, there is provided a spreader roller 20 and a pressure roller 22, which are forced together to form a nip by the roller loading device 24, which provides a way for adjusting the force applied by the pressure and spreader rollers 22, 20 to the printed portion on the web 14 when the web 14 is in the nip to spread the printed portion on the web. Roller loading devices are well known in the art and often include cams or air cylinders. The force applied to the spreader and pressure rollers 20, 22 by the roller loading device is based on signals 25 from the processor 18. In one example, the force is related to image content information.

The spreader and pressure rollers 20, 22 can be heated. One way is by internal heating lamp (or lamps) 26; the spreader and pressure rollers 20, 22 can also be heated externally as is well known in the art.

The spreader 16 also includes a motor or similar device (not shown) to rotate the spreader or pressure roller 20, 22 in the desired direction at the desired speed. Two sets of web drive rollers 28 and 30 are loaded against each other to form a nip and thus drive the web 14. The web drive rollers 28, 30 provide the web drive when the spreader and pressure rollers 20, 22 are separated. The same motor or similar device (not shown) that drives the spreader or pressure roller 20, 22 also drives the web drive rollers 28, 30. The web drive rollers 28, 30 do not need to be continuous across the axis of rotation; indeed, narrow web drive rollers are common in the art of web transport An image sensor 32 provides an image presence signal 33 to the processor 18 when an image 34 is present under the image sensor 32. The image sensor 32 is either inside the image path or outside the image path if fiduciary marks are provided by the solid ink jet engine 12 in conjunction with image content. The image sensor 32 is either a conventional area image sensor or a linear image sensor.

The force at the nip is reduced in response solely to the recognition of the non-image portion of the web 14 or it can take into account the image content information. When the image sensor 32 senses no image for a predetermined length of web 14, the image sensor 32 sends the image presence signal 33 to the processor 18, which sends a roller loading signal 35 to the roller loading device 24 to reduce the force by either separating the spreader roller 20 and pressure roller 22, or greatly reducing the nip force between them. If the spreader roller 20 and pressure roller 22 are separated, the web drive rollers 28 and 30 maintain web velocity; When image content, as provided to the processor 18, is reduced, the processor 18 sends the roller loading signal 35 to the roller loading device 24 to reduce force between the spreader roller 20 and the pressure roller 22 until the image content is increased. In both cases, the reduced force between the spreader roller 20 and pressure roller 22 reduces the amount of stress in the web 14 that causes wrinkles.

The invention has been described in detail with particular reference to certain preferred embodiments thereof, but it will be understood that variations and modifications can be effected within the spirit and scope of the invention.

PARTS LIST

10—Solid ink jet web printer
12—Solid ink jet engine
14—Web
16—Spreader
18—Processor
20—Spreader roller
22—Pressure roller
24—Roller loading device
25—Image content signal
26—Heating lamps
28—Web drive rollers
30—Web drive rollers
32—Image sensor
33—Image presence signal
34—Image
35—Roller loading signal

The invention claimed is:

1. A solid inkjet web printer for reducing wrinkles on a web comprising;

a solid ink jet engine for jetting a patterned layer of solid jettable ink against a printed portion of the web; and a system having a processor, and a spreader, the spreader having a pressure roller and a spreader roller wherein at least one is comformable forming a nip and means for adjusting the force applied at the nip; the processor causing the adjustment of the force applied by the pressure and spreader rollers to the printed portion on the web when the web is in the nip to spread the printed portion on the web; and causing the spreader to reduce the force when the non-image portion is in the nip; and a sensor for providing a signal to the processor indicating the location of the image and non-image portions of the web and the processor responding to the signal for causing the force adjusting means to reduce the force at the nip when the non-image portion is in the nip.

2. The solid inkjet web printer according to claim 1, wherein the force adjustment means includes at least one roller loading device for applying adjustable force to the pressure roller in response to the processor.

3. The solid inkjet printer according to claim 2, wherein the processor uses image content information to determine the amount of force to be applied by the roller loading device.

4. The solid inkjet printer according to claim 1, wherein the sensor is either an area image sensor or a linear image sensor.

* * * * *